US006129296A

United States Patent [19]

Campbell et al.

[11] Patent Number: 6,129,296

[45] Date of Patent: Oct. 10, 2000

[54] DOUBLE ROLL PEG FEEDER ASSEMBLY FOR FLAKING MILLS

[75] Inventors: Thomas Campbell, Tulia; James Rogers, Canyon; Kenneth Walser, Hereford, all of Tex.

[73] Assignee: Poarch Bros. Inc., Hereford, Tex.

[21] Appl. No.: 09/327,460

[22] Filed: Jun. 8, 1999

[51] Int. Cl.[7] ..... B02C 4/06

[52] U.S. Cl. ..... 241/30; 241/37.5; 241/225

[58] Field of Search ..... 241/30, 37.5, 135, 241/224, 225

[56] References Cited

U.S. PATENT DOCUMENTS

| | | |
|---|---|---|
| 1,366,463 | 1/1921 | Jones . |
| 1,560,313 | 11/1925 | Pittman . |
| 2,656,121 | 10/1953 | Tanner . |
| 2,925,226 | 2/1960 | Pratique . |
| 3,866,842 | 2/1975 | Linzberger . |
| 3,881,663 | 5/1975 | Brown . |
| 5,823,452 | 10/1998 | Ballew et al. . |

FOREIGN PATENT DOCUMENTS

| | | | |
|---|---|---|---|
| 1137927 | 10/1962 | Germany | 241/225 |

*Primary Examiner*—Mark Rosenbaum
*Attorney, Agent, or Firm*—Dowell & Dowell, P.C.

[57] ABSTRACT

A peg feeder and method of feeding moist grain from a steam chamber to a grain flaking mill. The feeder includes an inlet flow divider baffle for separating the grain into two flow channels each of which includes an adjustable valve door for controlling flow. The two flow channels include secondary baffles for directing the moist grain to opposite sides of a pair of spaced feed rollers which are mounted so as to converge the flow of grain from the two channels at a central discharge outlet. Access to the interior of the peg feeder is provided by removable panels and underlying safety grates.

16 Claims, 4 Drawing Sheets

12
5
56
44
43
54
58
25
32
36
34
33
10
60
37
94
95
82
89
28
96
18
19
20
5
21
14

DOUBLE ROLL PEG FEEDER ASSEMBLY FOR FLAKING MILLS

BACKGROUND OF THE INVENTION

1. Field of the Invention

This invention is generally directed to a method and apparatus for feeding moist grain from a steam chest or chamber to a pair of opposed crushing rollers in a flaking mill and more particularly to a peg feeder which incorporates a pair of feed rollers which are spaced relative to one another and to which moist grain is conveyed in separate flow paths from the steam chamber. The two grain streams are combined by the feed rollers at a central discharge outlet such that the feed of grain from the peg feeder is directed to the nip between the crushing rollers of the underlying flaking mill. The trajectory of grain from one feed roll opposes the trajectory of grain from the opposite feed roll thereby causing the grain flow to be directed in a straight drop into the nip of the crushing rollers. The invention is further directed to safety devices for preventing accidental access to the feed rollers of the peg mill, but which allows for ready access for purposes of maintenance and cleaning.

2. History of the Related Art

Peg feeders are used between grain steam chests or chambers and flaking mills to feed moist steam treated grain, which has passed through the steam chamber, into crushing rollers of the flaking mill for purposes of making flaked grain, which is then used as an ingredient in cattle feed. Conventionally, peg feeders incorporate a single feed roller which is used to direct the grain passing from the steam chamber to a baffle element which directs the grain toward the crushing rollers associated with the flaking mill.

In conventional peg feeders, as only a single roller is used, the grain flow is in a single direction with the grain passing along one side of the roller and being subsequently discharged on an opposite side toward a baffle which directs the moist grain to the crushing rollers of the flaking mill. This type of flow has caused problems with uniform volume or rate of flow and such irregularities in grain flow can interfere with the proper crushing of the grain as it passes through the crushing rollers of the flaking mill. In addition, the moist grain passing from the roller to the baffle can build up on the baffle and thus not flow directly to the nip or central area defined between the two crushing rollers. When this occurs, the moist grain is deposited offset from the nip resulting in reduced capacity and non-uniform crushing of the grain through the crushing rollers.

In addition to the foregoing, it is frequently necessary to clean and maintenance the crushing rollers associated with a peg feeder. Often, panels are provided to allow access to the interior of a peg feeder. However, if a panel is removed while the peg feeder is operated, injury may result from the accidental placement of a hand or arm into the interior of the peg feeder.

Some examples of prior art peg feeders are shown in U.S. Pat. No. 3,881,663 to Brown, and U.S. Pat. No. 5,823,452 to Ballew et al. Examples of grinding mills which incorporate supplemental feed rollers are disclosed in U.S. Pat. No. 3,866,842 to Linzberger, U.S. Pat. No. 2,925,226 to Pretique, U.S. Pat. No. 2,656,121 to Tanner and U.S. Pat. No. 1,366,463 to Jones.

In view of the foregoing, there remains a need to provide a peg feeder for use with flaking mills which will ensure a more uniform and directed flow of grain to the crushing rollers of the flaking mill often the grain is discharged from a steam chest or chamber to the peg feeder. Further, there remains a need to provide a safety access for cleaning and maintenancing of peg feeders utilized with flaking mills.

SUMMARY OF THE INVENTION

The present invention is directed to a peg feeder for use in providing a uniform and directed flow of moist grain from a steam chest or chamber to a flaking mill and to a method for providing such uniform flow which utilizes a pair of oppositely rotating and spaced feed rollers which are normally driven at the same speed towards each other. The peg feeder includes a feed inlet having a diverter baffle which divides the flow of moist grain from the steam chamber into two streams flowing in different directions and toward opposite sides of the spaced feed rollers. A pair of valve doors are provided adjacent the feed inlet and are moveable to control the flow of grain into the peg feeder, thus separating the grain in the stream chamber from the peg feeder. In a preferred embodiment, each valve door is mounted to a pneumatic or hydraulic cylinder which is operable in response to operating conditions of the flaking mill to regulate the opening and closing of the valve doors and thereby control the feed of the moist grain from the steam chamber to the crushing rollers associated with the flaking mill.

The feed rollers of the present invention include a plurality of tines or rods which extend outwardly therefrom for purposes of preventing compaction and build-up of moist grain within the peg feeder. Secondary baffles within the peg feeder form a trough adjacent to and beneath each of the feed rollers with the two troughs converging toward one another to a common discharge outlet. The discharge outlet of the peg feeder is oriented so as to be in direct alignment with the nip between the crushing rollers of the underlying flaking mill.

Utilizing the method and apparatus of the present invention, the flow of moist grain is first controlled and initially diverted into two separate streams at the inlet to the peg feeder. The split streams of moist grain are directed to opposite sides of the feed rollers. The feed rollers rotate toward one another and the tines of each roller force the two divergent streams of moist grain toward one another such that the two streams converge and merge to a single stream at the common discharge outlet. At the outlet, the merged stream free falls by gravity between the crushing rolls of the flaking mill. The discharge outlet is oriented so as to ensure that the combined flow of grain from the peg feeder is directed centrally of the nip between the crushing rollers, thus preventing the possible passage of grain about the crushing rollers without passing through the nip point of the crushing rollers.

The present invention further provides at least one removable panel which allows access to the interior of the peg feeder for purposes of cleaning and maintenancing the feed rollers and valve doors. Underlying each removable panel is a separate rigid grate which is secured by removable fasteners. Each grate includes spaced bars which prevent the inadvertent or accidental extension of an individual's hand therethrough and into the area of the feed rollers without first consciously removing the fasteners which secure the grate to the housing of the peg feeder. Therefore, the structure of the present invention increases safety and prevents inadvertent accidents.

It is the primary object of the present invention to provide a peg feeder for use in conveying moist grain from a steam chest or chamber to a flaking mill wherein the flow is divided at the inlet of the peg feeder and thereafter recombined by converging two divergent flow streams of grain at an area of discharge from the peg feeder to thereby provide a more uniform and free flow of grain from the peg feeder to the nip area of crushing rolls associated with the flaking mill.

It is also an object of the present invention to provide a peg feeder for use with a flaking mill which incorporates two spaced feed rollers, each receiving a separate flow of moist grain from a steam chest or chamber such that tines associated with the feed rollers will create a more uniform flow and wherein the point of convergence of the two flow streams is such as to redirect the flow streams by gravity to the nip of crushing rollers of the flaking mill and wherein caking or compaction of the moist grain is prevented within the feeder.

It is also an object of the present invention to provide a peg feeder for a flaking mill which incorporates a pair of spaced valve doors or panels for controlling flow of split streams of moist grain toward a pair of spaced rollers which function to loosen and redirect the streams of material toward one another and which valve doors are operative to control the rate of grain flow to the flaking mill.

It is yet a further object of the present invention to prevent unsafe and unauthorized access to the area of the feed rollers of the peg feeder by providing security grates beneath one or more removable panels associated with the peg feeder.

BRIEF DESCRIPTION OF THE DRAWINGS

A better understanding of the invention will be had with respect to the attached drawings wherein.

DESCRIPTION OF THE PREFERRED EMBODIMENT

Figure 1:
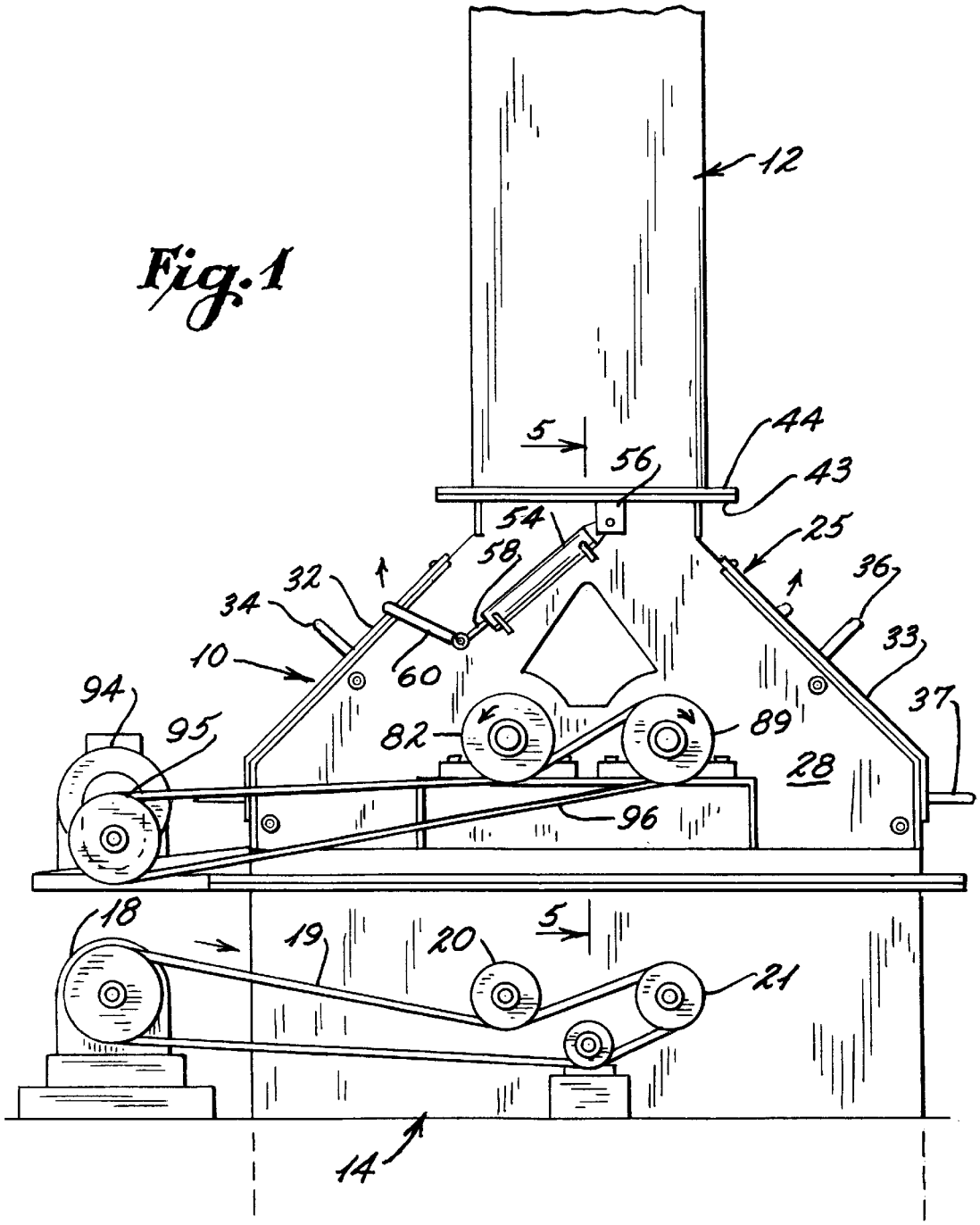
FIG. 1 is a front perspective illustrational view showing the peg feeder of the present invention mounted between an upper steam chamber and a lower flaking mill.
Figure 2:
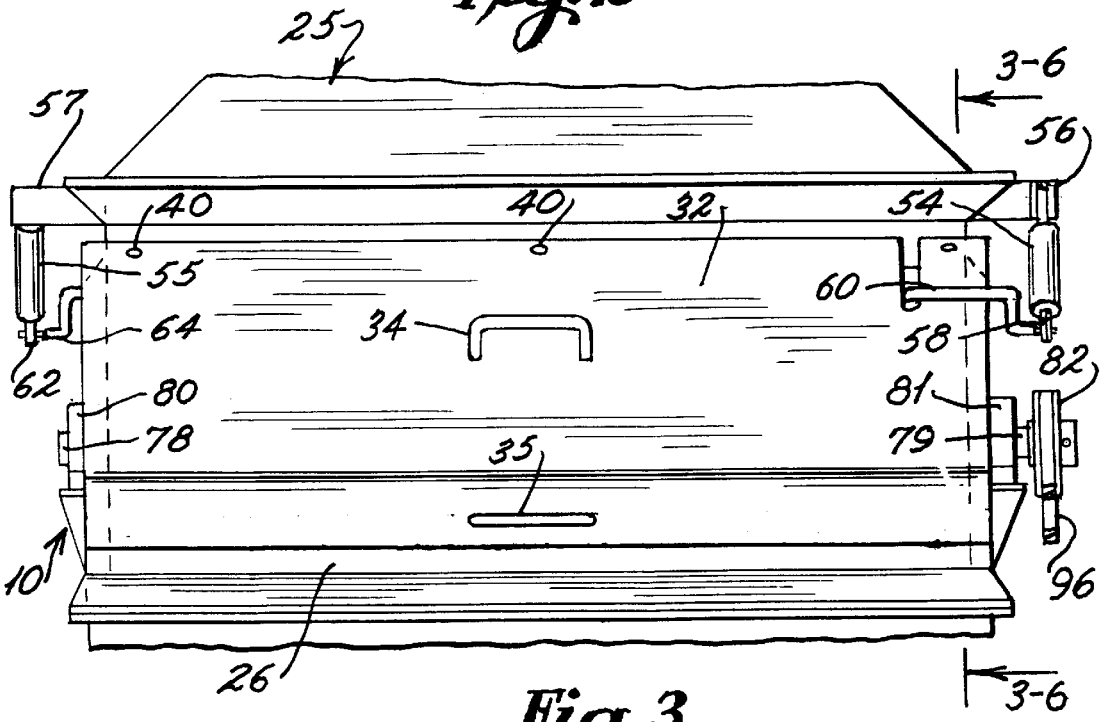
FIG. 2 is a view taken from the right side of the peg feeder shown in FIG. 1.
Figure 6:
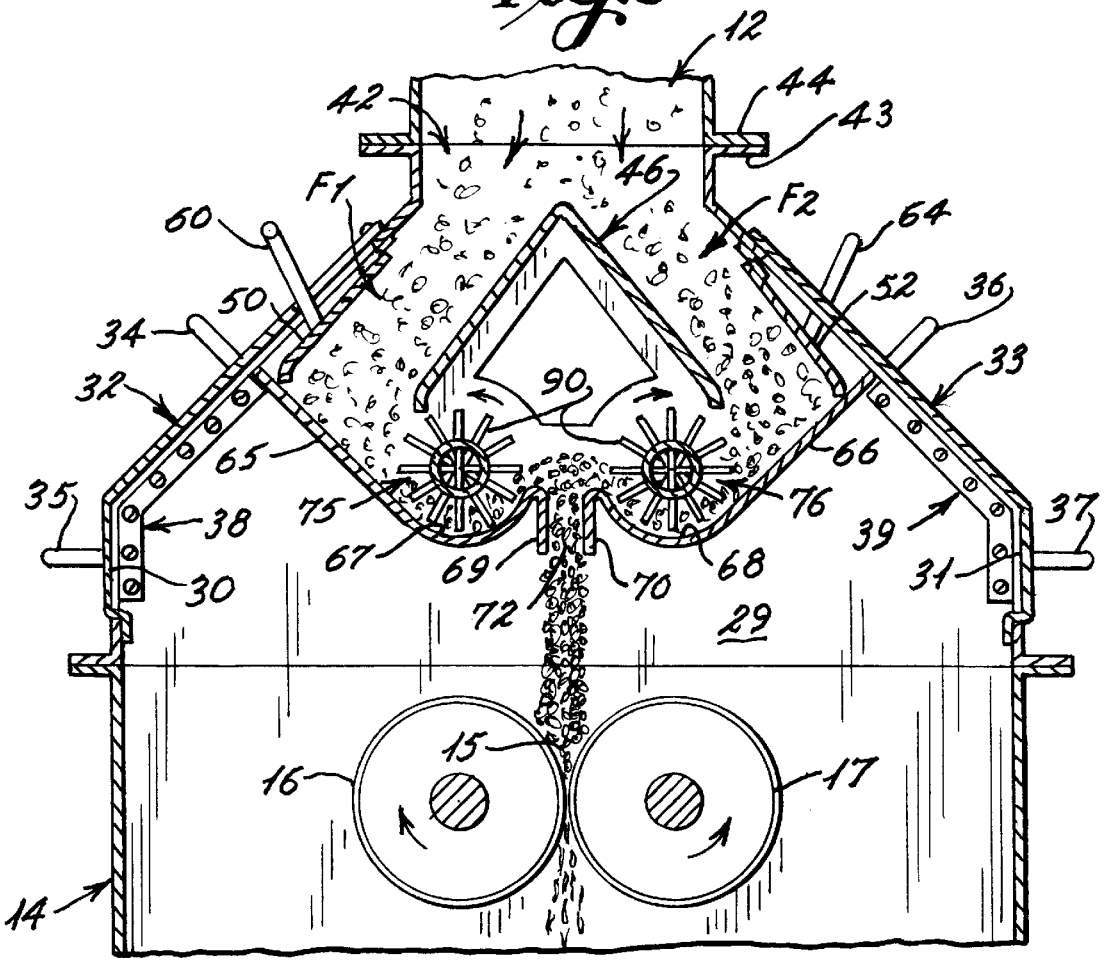
FIG. 6 is a view similar to FIG. 3 showing the valve doors open to create two separate flow paths toward the opposing feed rollers of the present invention.
Figure 7:
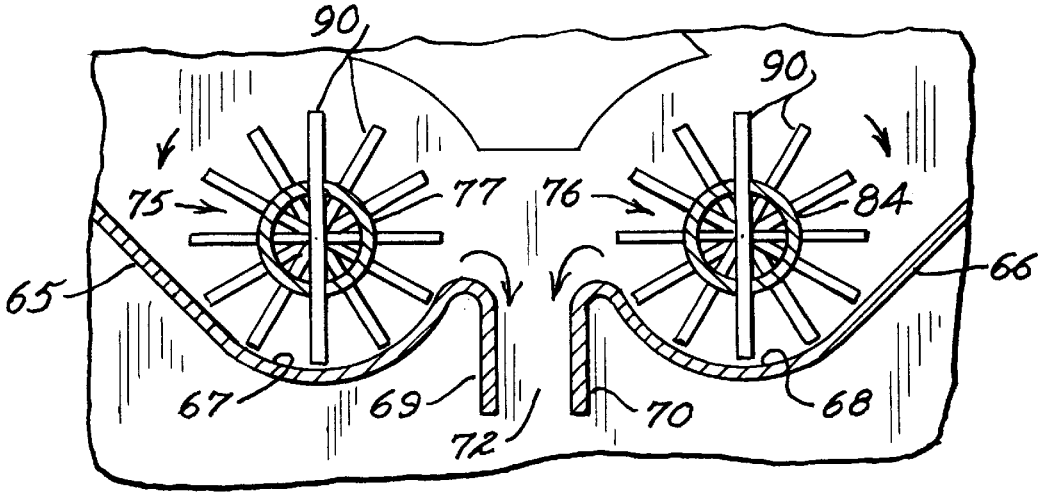
FIG. 7 is an enlarged cross-sectional view showing the feed rollers of the present invention and the manner in which the tines associated therewith are mounted to a central hollow cylinder of the rollers and showing by arrows the converging of flow direction of the separate moist grain streams toward the discharge outlet of the peg feeder.

With continued reference to the drawing figures, the peg feeder 10 of the present invention is shown as being mounted between a conventional grain steam chamber 12 and a flaking mill 14. The peg feeder is utilized to provide a continuous unobstructed flow of moist grain to the nip 15 between two crushing rolls 16 and 17 which are mounted within the flaking mill as illustrated in FIG. 6. As shown in FIG. 1, the two crushing rollers 16 and 17 are driven in counter-rotating motion by a motor 18 which drives a chain 19 about a pair of sprockets 20 and 21 which are connected to the primary shaft of each of the rollers 16 and 17, respectively. The drive mechanism and the rollers shown are for illustration only and the flaking mill may be of any design and construction. Likewise, the steam chamber 12 may be of any design or construction.

The peg feeder 10 includes an outer housing 25 defined by inclined side walls 26 and 27 and substantially closed end walls 28 and 29. To provide access to the interior of the peg feeder and the components mounted therein, openings 30 and 31 are provided in the side walls 26 and 27, respectively. The openings are normally closed by covers or panels 32 and 33, each having a pair of handles 34 and 35, 36 and 37, respectively, extending therefrom. Each cover is secured by several fasteners, such as bolts 40, in covering relationship with respect to the openings 30 and 31. To ensure safety and to prevent accidental injury to an individual's hand or arm when the components of the feeder are operative, each opening 30 and 31 is further covered by a safety grate 38 and 39, respectively. Each grate includes a plurality of generally parallel safety bars which are spaced to prevent extension of an individual's hand therethrough. By removal of suitable fasteners, the safety grates 38 and 39 can be removed to allow access to the interior of the peg feeder for purposes of cleaning and maintenance.

Figure 3:
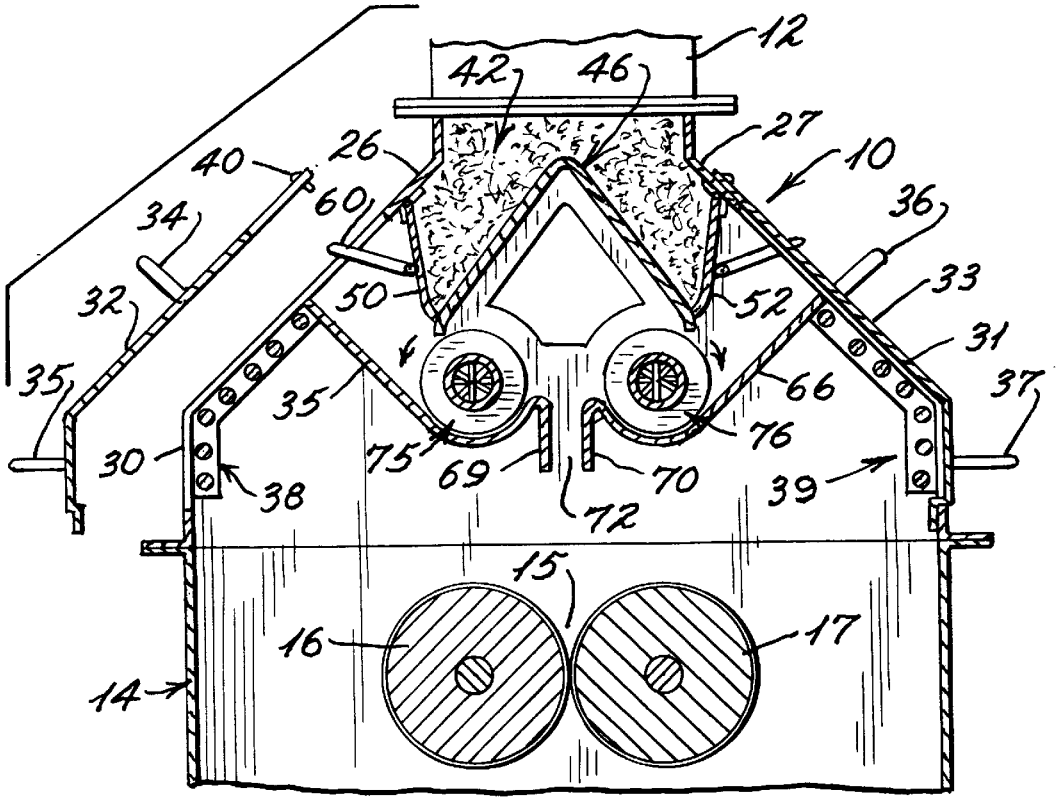
FIG. 3 is a cross-sectional view taken along line 3—3 of FIG. 2 showing the opposing feed rolls of the peg feeder of the present invention and the valve doors associated with the grain inlet of the peg feeder.
Figure 4:
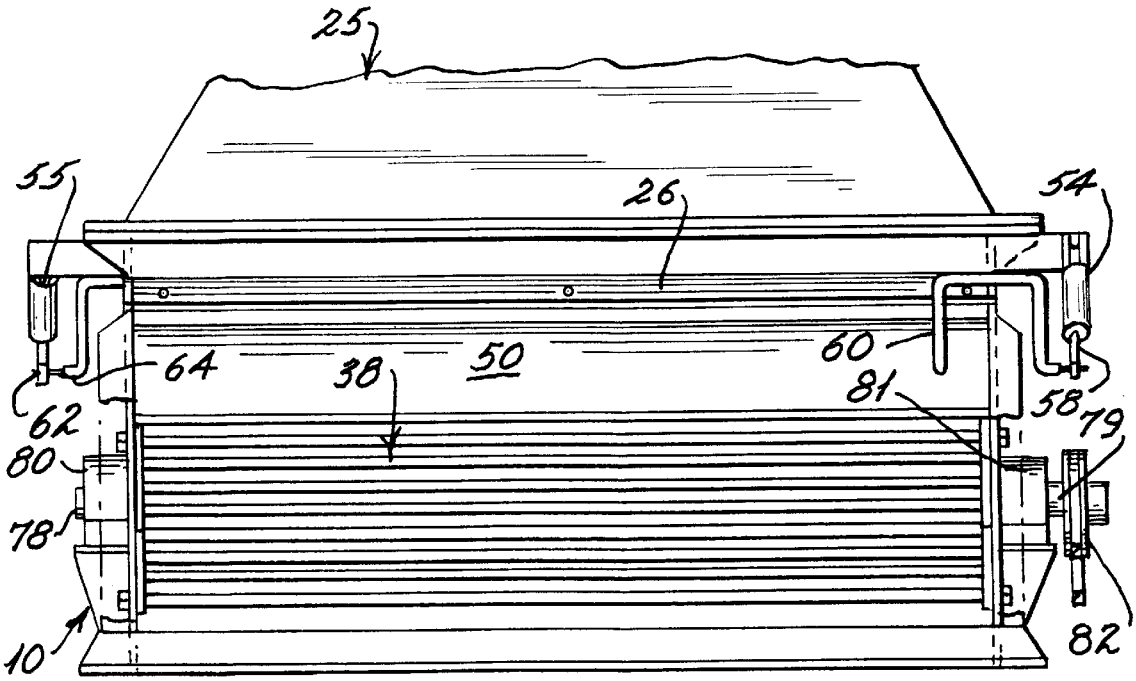
FIG. 4 is a view similar to FIG. 2 showing a removable access panel removed and exposing a safety grate for preventing access into the peg feeder.

The peg feeder 10 includes an inlet end 42 having a flange 43 which mates with a flange 44 on the lower portion of the steam chamber 12. Suitable fasteners are utilized to secure the flanges in sealed relationship. Spaced inwardly of the inlet end 42 is a generally inverted V-shaped deflector baffle 46 which extends the entire depth of the peg feeder housing. The deflector baffle is positioned so as to create two equal flow paths or channels on opposite sides thereof and toward the side walls 26 and 27 of the housing 25. The flow of moist grain coming from the steam chamber 12 is controlled by a pair of valve doors 50 and 52 which are hingedly mounted at 47 and 48, respectively, to the side walls 26 and 27 of the housing. The valve doors are controlled by actuation of pneumatic or hydraulic cylinders 54 and 55 which are mounted exteriorly of the housing 25 such as by brackets 56 and 57, respectively. The piston rod 58 of cylinder 54 is pivotally connected to a link arm 60 which is pivotally connected at its other end to the valve door 50 whereas piston rod 62 of piston 55 is connected through a link arm 64 to the valve door 52. By appropriate control of the pistons 54 and 55, the degree of opening of the valve doors 50 and 52 are adjusted. Generally, both valve doors will be operated to provide the same flow rate therethrough from a fully closed position, as shown in FIG. 3, to a fully opened position, as shown in FIG. 6. Although not shown in the drawing figures, manually operable levers may be utilized in place of the cylinders 54 and 55. It is preferred that the valve doors operate automatically and in controlled relationship with the operation of the flaking mill 14. In this respect, appropriate controls are provided such that when the flaking mill starts, the valve doors will open simultaneously to allow a split stream flow of moist grain to be introduced toward the crushing rollers of the flaking mill through the peg feeder. When the flaking mill is shut down, the valve doors will automatically close to shutoff the flow of grain to the flaking mill.

The flow of moist grain entering into the peg feeder through the valve doors is further directed by a pair of somewhat elongated U-shaped baffle members 65 and 66 which extend the full depth of the housing 25. Each of the baffles 65 and 66 defines a generally concave trough portion 67 and 68, respectively, and a generally vertical innermost portion 69 and 70 which define therebetween a flow or discharge exit 72 from the peg feeder. As specifically shown in FIG. 6, the discharge 72 is directly aligned above the nip area 15 defined between the crushing rollers 16 and 17 of the flaking mill 14 when the peg feeder is mounted thereto.

To ensure a uniform flow and to properly direct the flow of moist grain from the peg feeder to the nip area of the crushing rollers of the flaking mill, the present invention utilizes a pair of feed rollers 75 and 76 which are mounted intermediate the deflector baffle 46 and the troughs 67 and 68 defined by the baffles 65 and 66. Feed roller 75 includes a central hollow cylindrical shaft 77 which extends the depth of the housing 25. At each end of the cylinder 77 stub shafts 78 and 79 extend through support bearings 80 and 81, respectively. Stub shaft 79 further extends outwardly through a drive sprocket 82. Feed roller 76 includes a central hollow cylindrical shaft 84 which extends the depth of the housing 25 and which is mounted by stub shafts 85 and 86, see FIG. 5, to support bearings 87 and 88. Stub shaft 86 further extends outwardly and is connected to a drive sprocket 89.

Figure 5:
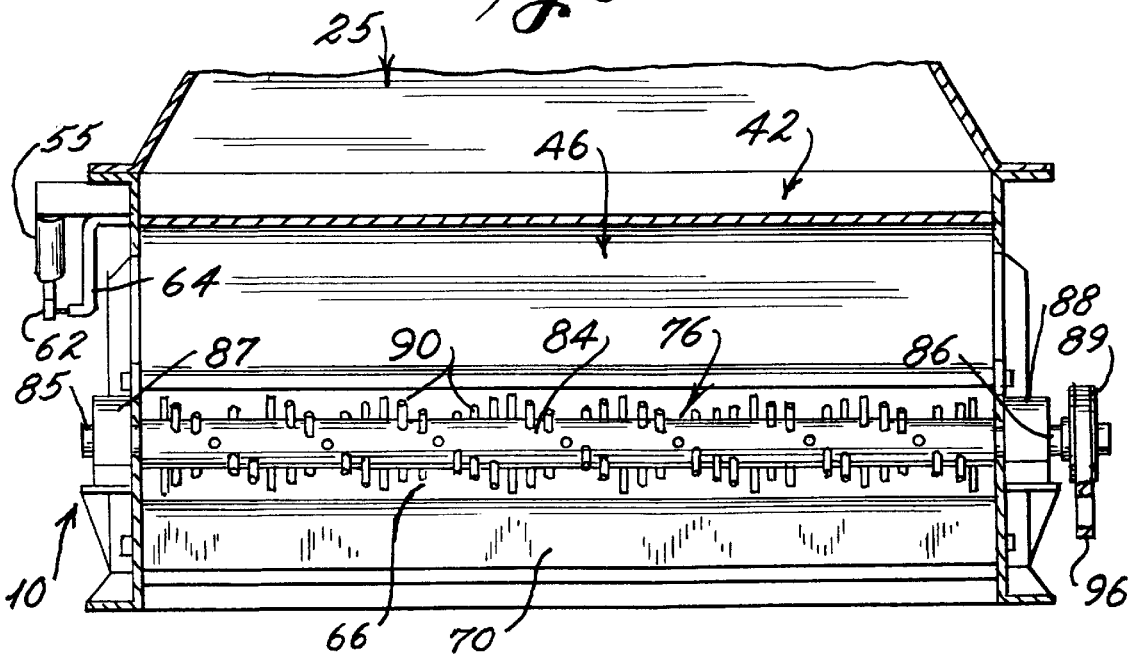
FIG. 5 is a cross-sectional view taken along line 5—5 of FIG. 1.

Each of the feed rollers includes a plurality of rods or tines 90 which are mounted through aligned openings therethrough such as to form a helical pattern of the tines projecting outwardly on opposite sides of the shafts, as is shown in FIG. 5. Other types of mounting arrangements and spacings may be utilized for the tines and be in keeping with the teachings of the present invention. The tines act as feeding fingers for not only urging moist grain toward the discharge area 72 of the peg feeder, but also to break-up the moist grain so that the flow of the material is more constant and uniform and such that material does not become packed or compacted within the peg feeder.

The feed rollers 75 and 76 are driven in opposite directions, as is shown by the arrows in FIG. 6, so as to direct the moist grain flowing in the split flow paths or channels F1 and F2 toward the discharge 72. The rollers are driven in synchronization with respect to one another and, in this respect, a drive motor 94 is mounted exteriorly of the housing 25 and includes a drive sprocket 95 over which extends a drive chain 96. The drive chain engages the drive sprockets 82 and 89 associated with the feed rollers 75 and 76.

In the use of the peg feeder of the present invention, the feeder is mounted intermediate the lower portion of a steam chamber 12 and above an inlet end 98 of a flaking mill 14. Before the flaking mill is operated, the valve doors 50 and 52 are closed as shown in FIG. 3. Moist grain coming from the steam chamber is prevented from passing into the peg feeder. Upon operation of the crushing rolls 16 and 17 of the flaking mill, the motor 94, which drives the feed rollers 75 and 76, will be activated causing the rotors to rotate in opposite directions as shown in drawing FIG. 6. Thereafter, the cylinders 54 and 55 will operate to move the valve doors 50 and 52 to an open position, such as shown in FIG. 6, causing two flow paths or grain streams F1 and F2 to be directed to the respective feed rollers 75 and 76. As the feed rollers rotate, the tines 90 extending therefrom will loosen and mix as well as feed the two grain streams toward one another so that the streams merge and fall by gravity directly through the discharge opening 72 between the baffles 65 and 66 such that the merged stream of grain enters the nip 15 between the crushing rollers 16 and 17 of the flaking mill.

Should maintenance or cleaning of the interior of the peg mill be required, the outer panels or covers 32 and 33 are removed by lifting the panels from the side walls 26 and 27 of the housing 25. The safety grates 38 and 39 will prevent accidental injury to operators. The grates must be removed in order to allow access to the working interior of the peg feeder. Further, although not shown in the drawing figures, an appropriate electrical switch may be connected to each of the grates 38 and 39 such that if the grates are displaced, the motor 94 for driving the feed rollers 75 and 76 will be automatically deactivated thereby preventing possible accident and injury.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. A peg feeder apparatus for supplying moist grain introduced thereto from a source to crushing rollers of a flaking mill, the peg feeder comprising, a housing having an upper inlet end and a lower discharge end, opposite side walls, and front and rear walls, first baffle means mounted within said housing adjacent said inlet adapted to divert a flow of material into two separate streams along two separate flow paths within said housing, a pair of spaced second baffle means for diverting the two flow paths inwardly of said housing and toward one another, a pair of feed rollers mounted within said housing in spaced relationship with respect to one another and on opposite sides of a discharge exit defined between said feed rollers, and means for rotating said feed rollers in opposite directions with respect to one another so as to urge the two material streams toward one another such that the material streams merge as a combined stream and pass through said discharge exit from said housing.

2. The peg feeder of claim 1 in which said first baffle means for diverting includes a generally inverted V-shaped baffle member having an apex oriented toward said inlet opening in said housing.

3. The peg feeder of claim 2 in which each of said second baffle means includes a concave trough portion, one of said rotors being mounted so as to rotate generally within said concave trough portion of each of said second baffle means.

4. The peg feeder of claim 3, including valve means for selectively controlling the flow of material into said housing.

5. The peg feeder of claim 4 in which said valve means includes a pair of door elements mounted on opposite sides of said first baffle means and between said first baffle means and said side walls of said housing, and means for pivoting said door elements relative to said first baffle means and said side walls of said housing for regulating the flow of the material streams therebetween.

6. The peg feeder of claim 5 in which said means for selectively controlling includes a pair of cylinder means each having an extension rod, a link means for connecting each of said extension rods with a separate one of said door elements.

7. The peg feeder of claim 6, including an opening in at least one of said side walls, a cover normally covering said opening in said at least one of said side walls, a safety grate mounted in underlying relationship to said cover and extending across said opening in said at least one of said side walls and means for securing said grate to said housing.

8. The peg feeder of claim 6, including means for uniformly rotating said feed rollers in opposite directions with respect to one another.

9. The peg feeder of claim 6 in which each of said feed rollers includes a generally hollow center shaft having a plurality of aligned openings therethrough, and tine elements extending through said openings and outwardly with respect to said cylindrical central portion.

10. The peg feeder of claim 1, including an opening in at least one of said side walls, a cover normally covering said opening in said at least one of said side walls, a safety grate mounted in underlying relationship to said cover and extending across said opening in said at least one of said side walls and means for securing said grate to said housing.

11. The peg feeder of claim 1, including means for uniformly rotating said feed rollers in opposite directions with respect to one another.

12. The peg feeder of claim 11 in which each of said feed rollers includes a generally hollow center shaft having a plurality of aligned openings therethrough, and tine elements extending through said openings and outwardly with respect to said cylindrical central portion.

13. The peg feeder of claim 12 in which said openings in said shafts of said feed rollers are oriented in a helical pattern such that said tine elements extend in a helical pattern relative to said shafts of said feed rollers.

14. The peg feeder of claim 11 in which each of said feed rollers are drivingly connected to a common drive means.

15. A method of feeding moist grain from a steam chamber to the nip area of a pair of crushing rollers of a flaking mill comprising the steps of;

a. separating a flow of moist grain from the steam chamber into two divergent streams along separate flow paths, b. converging the streams toward one another so that said streams merge to form a single discharge stream, and c. directing the single discharge stream to the nip area of the crushing rollers.

16. The method of claim 15, including the additional step of agitating each of the streams as the streams are converged.

* * * * *